US006354372B1

(12) United States Patent
Carisella et al.

(10) Patent No.: US 6,354,372 B1
(45) Date of Patent: Mar. 12, 2002

(54) SUBTERRANEAN WELL TOOL AND SLIP ASSEMBLY

(75) Inventors: James V. Carisella, Santa Rosa, FL (US); Robert Bradley Cook, New Orleans, LA (US)

(73) Assignee: Carisella & Cook Ventures, Santa Rosa, FL (US)

( * ) Notice: Subject to any disclaimer, the term of this patent is extended or adjusted under 35 U.S.C. 154(b) by 0 days.

(21) Appl. No.: 09/482,502

(22) Filed: Jan. 13, 2000

(51) Int. Cl.[7] ..... E21B 1/129
(52) U.S. Cl. ..... 166/118; 166/134; 166/217
(58) Field of Search ..... 166/118, 134, 166/138, 217

(56) References Cited

U.S. PATENT DOCUMENTS 3,530,934 A * 9/1970 Kisling, III ..... 166/134
3,570,596 A * 3/1971 Young ..... 166/134
4,949,786 A * 8/1990 Eckert et al. ..... 166/208
5,131,468 A * 7/1992 Lane et al. ..... 166/120
5,350,013 A * 9/1994 Jani et al. ..... 166/217
5,390,737 A * 2/1995 Jacobi et al. ..... 166/184
5,839,515 A * 11/1998 Yuan et al. ..... 166/387

* cited by examiner

*Primary Examiner*—William Neuder
(74) *Attorney, Agent, or Firm*—Beirne Maynard & Parsons LLP.

(57) ABSTRACT

A slip assembly for anchoring a subterranean well tool, such as a packer or bridge plug, along the inner wall of a conduit, such as casing, against movements in at least one direction. As a series of radially aligned slip elements move from contracted to expanded positions, a continuous radial inwardly urging bias is applied against the slip elements to permit the slip elements to move to the expanded position in a substantially uniform plane of expansion. A subterranean well tool includes an elastomeric seal and the slip assembly.

30 Claims, 4 Drawing Sheets

SUBTERRANEAN WELL TOOL AND SLIP ASSEMBLY

BACKGROUND OF THE INVENTION (1) Field of the Invention

The invention relates to a subterranean well tool incorporating a slip assembly for anchoring the well tool along an inner wall of a conduit against movements in at least one direction. A subterranean well tool includes an elastomeric seal and the slip assembly.

(2) Description of the Prior Art

Subterranean well tools, such as packers, bridge plugs and the like, often are introduced or carried into a subterranean oil or gas well on a conduit, such as wire line, electric line, continuous coiled tubing, threaded work string, or the like, for engagement at a pre-selected position within the well along another conduit having an inner smooth wall, such as casing. It is desired that the well tool be set and anchored into position along the smooth wall of the desired conduit such that movements in various directions such as upwardly, downwardly, and/or rotationally, are resisted, and, in fact, prevented. Such movements may occur as a result of a number of causes, such as pressure differentials across the tool, temperature variances, tubing or other conduit manipulation subsequent to setting for activation of other tools in the well, and the like. Accordingly, devices commonly referred to as "slips" or "slip assemblies" have been utilized for the anchoring function.

Typically, such slip assemblies are manufactured of a frangible cast iron which is intended to fracture into segments upon outward expansion to the set position. The fracture event is nearly "explosive" and the slip segments can jump off and away from the plug or packer housing and even fall down hole. Such slips are usually driven radially outwardly to the set position by means of a circular cone-type component which is driven by an activating mandrel against the inner wall of the slip elements to separate them such that teeth defined around the outer surface of the separated slip members may be driven into the wall of the conduit. Fragmenting slip segments can break up non-uniformly and orient in a skewed alignment or non-uniform circumferential distribution on the wedging cone, resulting in the axis of the plug or packer tool to be non-concentric and non-parallel with the longitudinal center line of the casing or other tubular. This result could adversely effect the anchoring and sealing performance of the packer or other tool incorporating the slip assembly. In other words, in many instances, the individual slip elements may not expand outwardly in one radial plane such that they are in continuous planer alignment during the expansion movements. This may result in one slip portion being set higher or lower than other slip portions and could result in a breaking or other failure, such as metallic fatigue, in the slip component, resulting in skewing and misalignment of the packer or bridge plug in the well.

The present invention is directed to the problems associated with the prior art set forth above.

SUMMARY OF THE INVENTION

In one aspect, the present invention provides a slip assembly for anchoring a subterranean well tool, such as a packer, bridge plug, or the like, along the inner wall of a conduit, such as casing, against movements in at least one direction, or, preferably, any direction. In particular, the slip assembly is particularly useful when the well tool is to be designed for applications requiring high expansion ratios between run-in and set positions. The slip assembly comprises a series of radially aligned slip means, which may be a series of breakable slip elements or, alternatively, may be provided in any configuration known to those skilled in the art. The slip means are moveable from a contracted position to an expanded position when it is desired to anchor the well tool within the well along the inner wall of the conduit. Means such as a flat wrapping of metal, a spring or the like, are provided for applying a very rigid, stiff continuous, radial inwardly urging bias against the slip means, whereby the slip means move in a substantially uniform plane of expansion parallel with the longitudinal center line of the tubular conduit upon which the device is to be anchored during movements to said expanded position.

In another aspect, the invention defines a slip assembly in which a receiving profile including first and second shoulders are defined on the slip means. Means, such as a continuous length or belt of metallic material, such as a band of flat stainless steel wire, is wrapped within the profile with each layer abutting the shoulders, thereby applying a stiff continuous inwardly urging circumferential bias against the slip means during movements to the expanded position. Means, such as a length of thin bailing wire, may, in turn, be wrapped around the layers of the metal belt for reducing the bias resulting from the wrapping configuration of the belt around the slips as the slips are moved toward the expanded position while also resisting unwrapping of the belt means. In another aspect, the invention provides a subterranean well tool for setting along the inner wall of the first conduit and against movements in at least one direction. Means, such as threads, or other typical connection are provided for securing the tool to a second conduit, such as continuous coil tubing, for introducing and carrying the tool within the well to a preselected position. An elastomer providing a packer component is moveable into sealing relationship on the inner wall during the setting of the subterranean well tool. A slip assembly is provided for anchoring the well tool along the inner wall and against movements in at least one direction. The slip assembly is as previously described.

In yet another aspect, the invention also provides a back-up, or secondary, seal system for incorporation into a well tool having a primary elastomeric seal component and may be used with or without the slip assembly described herein.

DESCRIPTION OF THE PREFERRED EMBODIMENTS

Figure 1A:
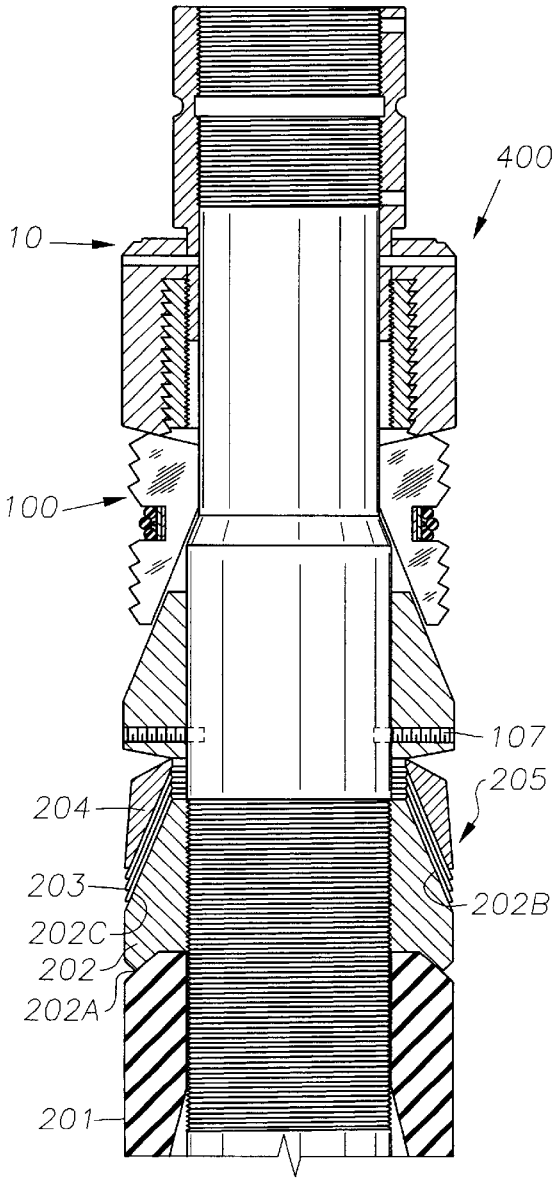
FIGS. 1A and 1B together constitute a longitudinal sectional view of the slip assembly of the present invention incorporated within a packer assembly including a secondary seal assembly and illustrated in the run-in position.
Figure 1B:
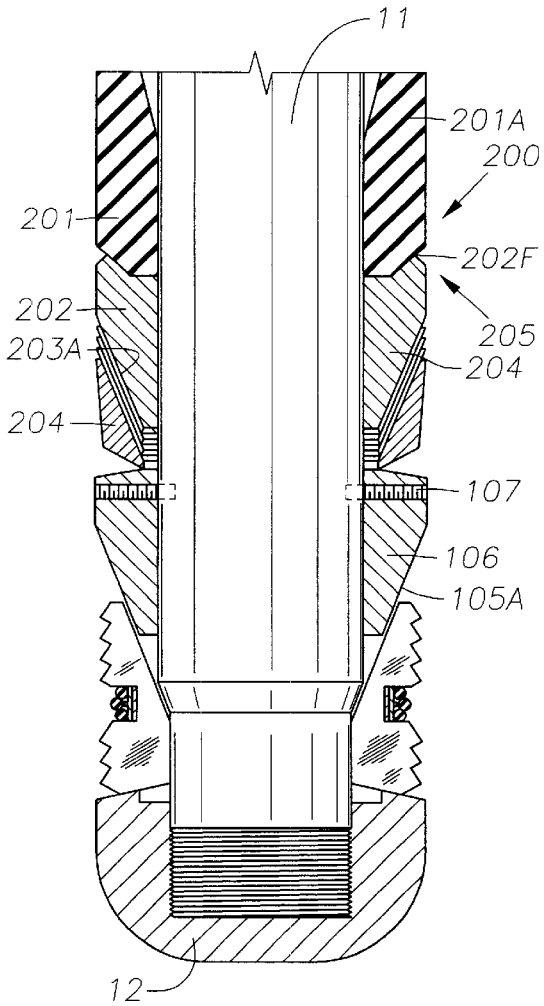

Now referring to FIGS. 1A and 1B, the apparatus 10 is shown carried on a conduit (not shown) into the well and, as shown, is in the run-in position prior to being introduced into a subterranean well. The apparatus 10 includes upper and lower slip assemblies 100 on a packer assembly 200 which includes an elastomeric packer 201, upper and lower nitrile or other similar backup elastomers 202, a series of radially overlapping metal supports 203 and top and bottom outer metal shields 204. The backup elastomers 202, the supports 203 and the shields 204 make up a support seal assembly 205.

As shown in FIGS. 1A and 1B, the apparatus 10 includes upper and lower slip assemblies and, accordingly, is designed to resist movements of the apparatus 10 in multi-directions, i.e., upward, downward and rotational or spiral movements. It will be appreciated that a subterranean well tool apparatus 10 may be configured as contemplated herein with only one slip assembly 100, being located in the proximal location of either the upper slip assembly 100 or the lower slip assembly 100.

Figure 2:
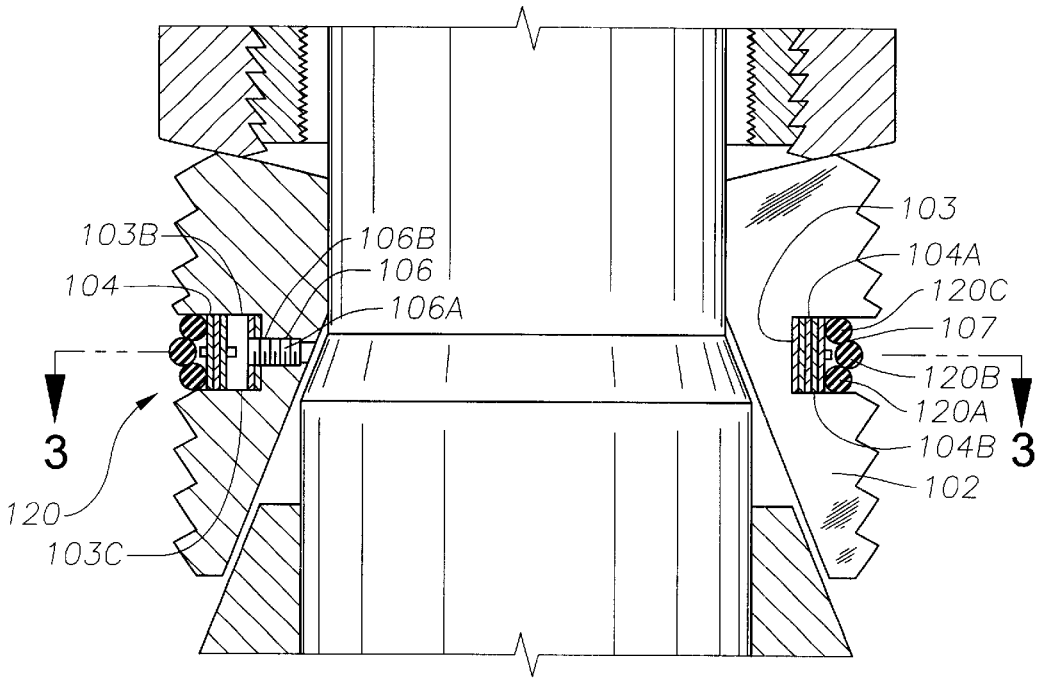
FIG. 2 is a sectional view of the slip assembly of the present invention in the contracted position and taken along line 2—2 of FIG. 3.
Figure 3:
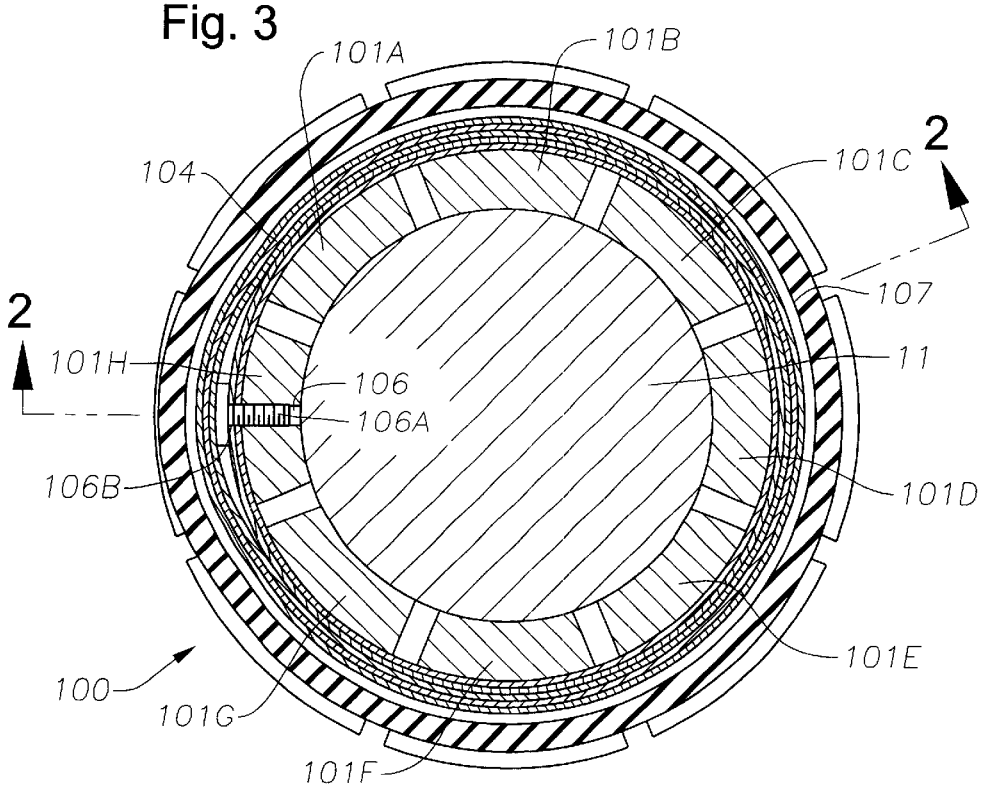
FIG. 3 is a sectional view taken along line 3—3 of FIG. 2.

As shown in FIG. 3, each slip assembly 100 includes a series of slip members 101A through 101H which may be independent and separated from one another or partially segmented and joined to one another around their lowermost ends. Each slip member 101A–H contains a series of serrated outwardly protruding teeth profiles 102 (FIG. 2) configured thereon for grasping along the inner wall IW of a casing or other conduit C within the well W at the depth of desired setting of the apparatus 10.

Now with particular reference to FIGS. 2 and 3, each of the slips 101A–H has a circumferentially extending grooveway 103 intermediate the upper and lower ends thereof. One of the slip members 101A-H has a bore 106 disposed there through for receipt of a retaining ravel screw 106A introduced through one end of an elongated metallic belt 104 having upper and lower edges 104A, 104B for effective contact with companion upper and lower shoulders 103B and 103C of the grooveway 103. The belt 104 is wound around the slips 101A–H and the screw 106A is inserted through, preferably, at the point 106B of completion of one wrapping of the belt 104 as well as again through the belt 104 immediate the beginning of the first wrap so that the screw 106A passes through the belt 104 twice. In such manner, an initial securement of the slips 101A–H, one to another in a closed loop is provided. The entire length of the belt 104 is several times the outer diameter of the slip assembly 100 and is wrapped around the slips 101A–H, a number of times as required, to provide a multiple wrapping configuration of the belt 104 within the grooveway 103, such that the belt 104 is tightly wound within the grooveway 103 with the upper and lower edges 104A, 104B and snugly engaged relative the shoulders 103B and 103C. All of the slip members 101A–H are thus tightly held in side-by-side abutting relationship to one another in the run-in or contracted position.

Preferably, the belt 104 may be of flat stainless steel wire, such as 0.375 inches wide and 10 to 15 thousandths of an inch thick.

Subsequent to wrapping the belt 104, as above describe, and while maintaining the belt 104 tightly around the slips 101A–H in the grooveway 103, a wire wrap 107 is secured around the exterior of the wrapped belt 104 to retain the tight relationship of the belt 104 around the slips 101A–H. The wire wrap 107 may be $16^{th}$ inch diameter "bailing wire", a short length of same being hand twisted at 107A after securement around the belt 104 to provide a snug fit relative to the belt 104 and to provide additional means for resisting unwinding of the belt 104 as the slips 101A–H move into the expanded position from the run-in or contracted position.

As particularly illustrated in FIG. 2, the cover means 120 as illustrated are disposed within the grooveway 103 and outboard of the belt 104. As shown, the cover means 120 may be a series of elastomeric o-ring elements 120A, 120B and 120C, snugly contacting one another. Alternatively, the cover means 120 may be a garter spring or any type of conventional sealant or protectant, such as a spiral of quick setting silicone or other elastomer, or may be in the form of a light or thin wire, mesh or cloth. Once the twist 107A of the wire 107 is snapped, the cover means 120 will also act as the primary means for thereafter resisting further unwinding of the belt 104.

Figure 4:
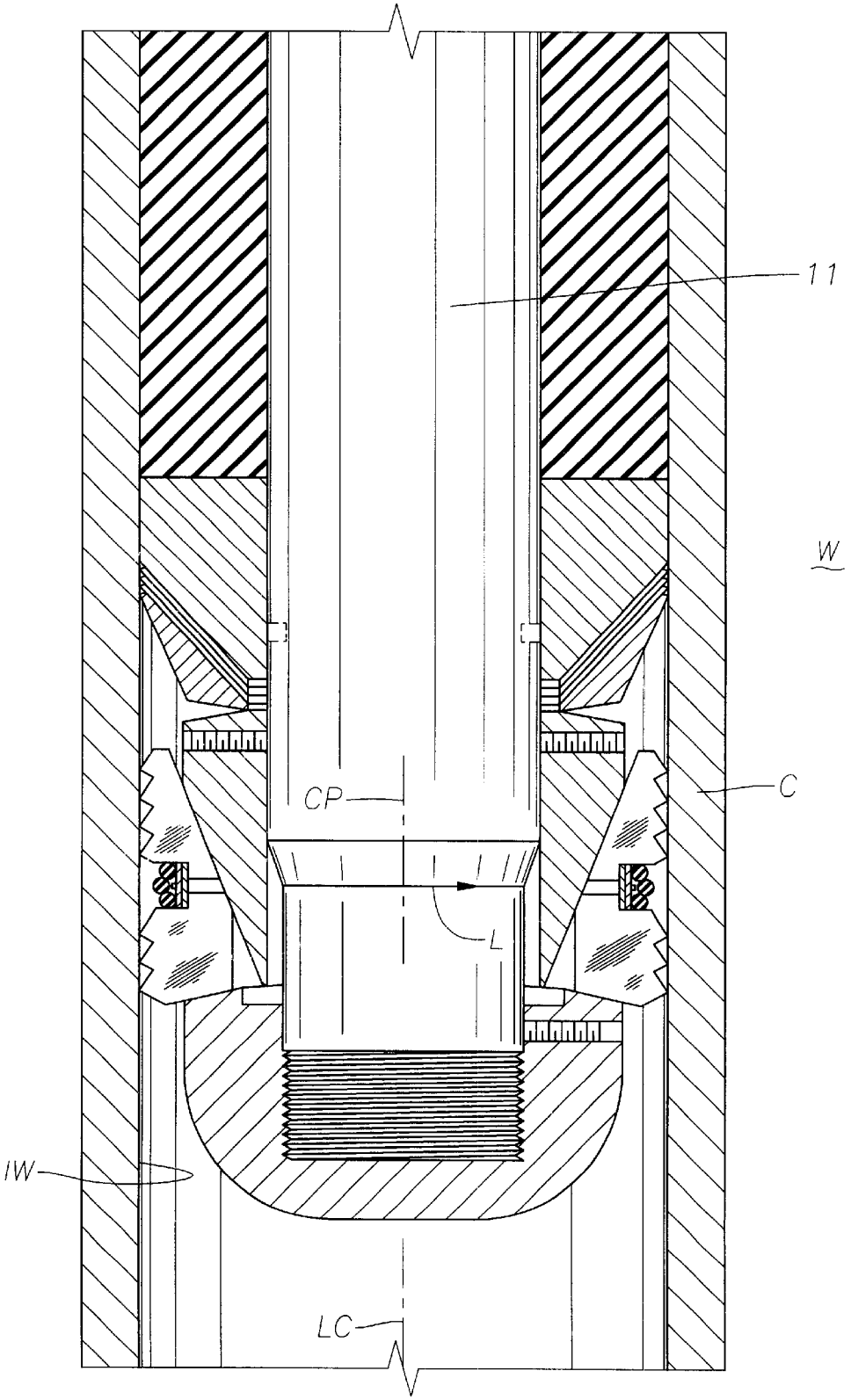
FIG. 4 is a sectional illustration of that portion of the device shown in FIG. 1B in expanded, or set, position/and sealingly anchored against casing within a subterranean wellbore.
Figure 5:
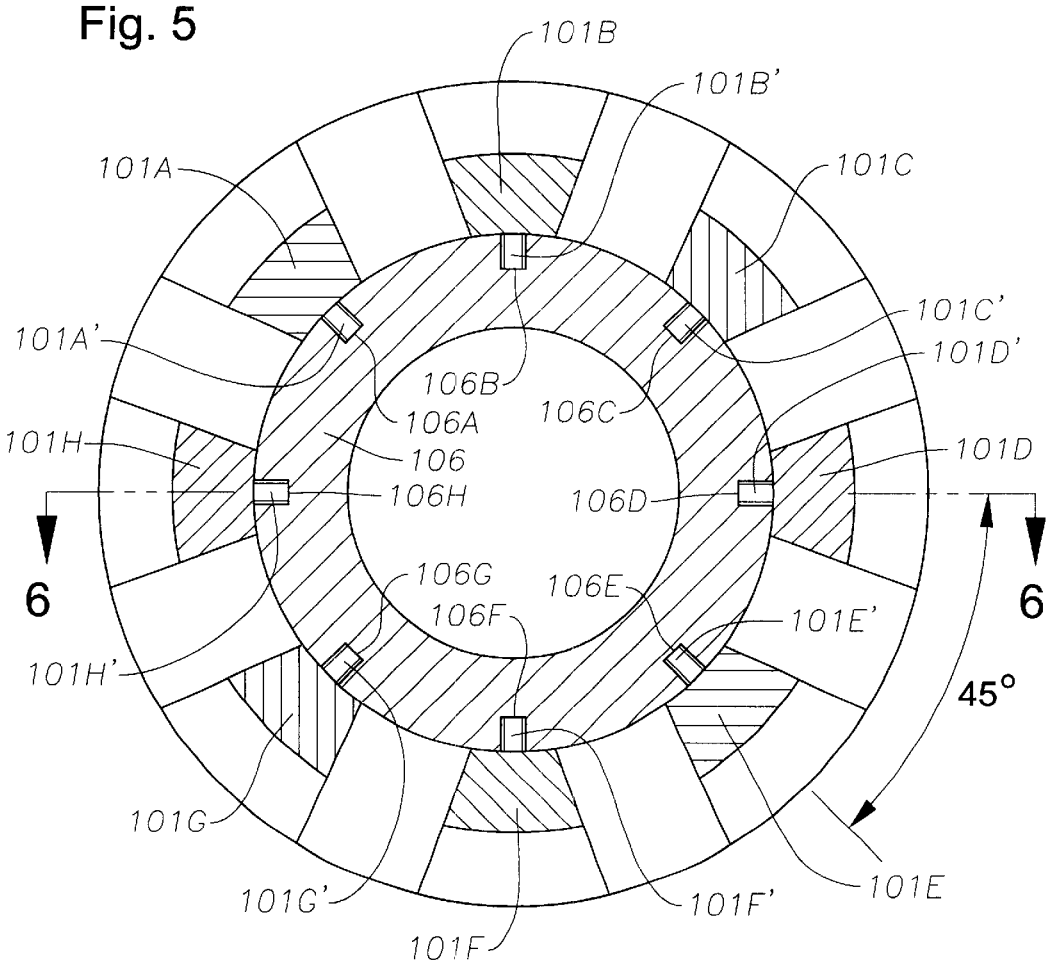
FIG. 5 is a horizontal cross-sectional view of an alternative design for the slip assembly to provide enhanced uniform circumferential alignment between the slip elements during movements to the expand position.
Figure 6:
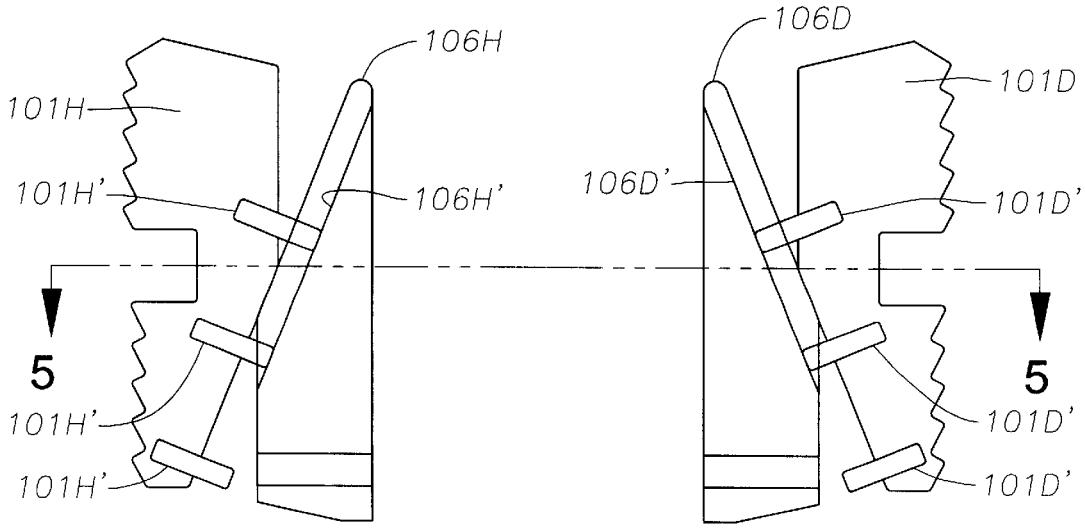
FIG. 6 is a view taken along line 5—5 of FIG. 5.

As shown in FIG. 4, it is desired that the slip assembly 100 move outwardly to the expanded, or set position in a substantially uniform axial plane of expansion, i.e., across a line L 45 degrees from the center point CP of the interior of the slip assembly 100. The substantially uniform axial plane of expansion will also be parallel with the longitudinal centerline CL of the casing C or other tubular. Additionally, as shown in FIGS. 5 and 6 and as described below, initial uniform radial orientation is maintained during movements between each of the slip members 101A–H may also be provided by a pin and groove configuration.

Referring again to FIGS. 1A and 1B, the slip assembly 100 also includes a cone member 106 housed inwardly of the slip members 101A–H and having an outward inwardly tapered surface 106A for contact with the contoured inner surface 10SA on each of the slips 101A–H such that the movement of the contoured inner surface 105A relative to the taper 106A on the cone 106 urges the slip members 101A–H outwardly from initial retracted position shown in FIGS. 1A and 1B to the set, expanded position in FIG. 4. The cones 106 are retained in the run-in position by means of shear pins 107 housed between the cone 106 and a control mandrel 11. Upon upward pull on the control mandrel 11, the pins 107 will shear, enabling relative movement between the cones 106 and slip members 101A–H, as described.

Of course, the design of the slips 101A–H, and/or the cones 106 may be one of a number of configurations, with, or without companion tapered surfaces.

When the apparatus 10 is provided with multiple sets of slip assemblies 100, the lower shear pin 107 may have a higher tensile strength than that of the upper shear pin 107 to enable shearing of the upper pin before the lower pin to permit the upper slip assembly 100 and the packer assembly 200 to set prior to activation of the lower slip assembly 100, in known fashion.

As shown in FIGS. 1A and 1B, the apparatus 10 also includes an elastomeric packer assembly 200 having an elastomeric packer 201 the construction and composition of which can be one of many well know to those skilled in the art. The elastomeric packer 201 has an outer wall 201A which will seal against the inner wall IW of the casing or other conduit C as the apparatus 10 is manipulated to the expanded position.

The elastomeric packer 201 is sandwiched between upper and lower support or secondary seal assemblies 205. The support or secondary seal assemblies 205 include an elastomeric nitrile-containing sealant or other metallic backup elastomer 202 having one end 202A contactingly profiled for snug fit against one end of the elastomeric packer 201 and having its outboard portion 202B angularly configured at 202C for receipt of comparatively and complimentary angled outer metal sheet members 203 which, preferably as shown, are provided in a series of three outwardly flexible elements which circumferentially stagger or overlap any open area between extension portions. The backup seal assembly 205 terminates by provision of an outer metal shield means 204 having a portion 204A housed within the interior shell 203A of the shield member 203 and shouldered at one end 202F against the packer 201.

An alternatively preferred embodiment of the present invention is illustrated in FIGS. 5 and 6. In this embodiment, uniform radial separation is provided between each of the respective slip elements 101A–101H during movements between the run-in contracted position toward the expanded, or set, position. The embodiment illustrated in FIGS. 5 and 6 preferably will be combined with the belt 104 and groveway 103 concepts as above discussed and as illustrated in FIGS. 1A and 1B. As shown in FIG. 5, each of the slip members 101A–101H have a center line which is offset a specific amount, such as 45 degrees, as shown, during all movements from the run-in position shown in FIG. 5 to the expanded position shown in FIG. 6. Each of the slip members 101A–101H contain at least one, or a series of outwardly protruding pin elements, such as 101D' and 101H' (FIG. 6) which are slidably, but snugly, engaged within a receiving lowerly and outwardly beveled companion groveway, such as 106D' and 106H' (FIG. 6). Accordingly, as the cone 106 and slip members 101A–101H are moved relative to one another during the setting operation, the snug fit of the pins 101A'–101H' within the receiving groveway 106A–106H assures integrity of uniform radial continuous alignment of such slip members during movements.

The apparatus 10 terminates in shoe 12 at its lowermost end and outwardly of the lower most slip assembly 100.

Operation

As discussed earlier, the slip assembly 100 of the present invention may be utilized in a number of subterranean well tools in which it is desired to provide anchorage of the tool at a preselected depth and positioned within the well W along the smooth wall of a conduit, such as casing C.

The slip assembly 100 typically may be utilized with any conventional elastormeric packer assembly 200 to define an apparatus 10 which may be carried on any one of a number of well known conduits into the well, such as wire line, electric line, continuous coil tubing, or threaded workover or other tubular string.

The apparatus is secured to the lowermost end of such conduit run into the well W as shown in FIG. 1A. When it is desired to activate the apparatus 10 to set same along the inner wall IW of the casing C at the preselected depth, a setting tool (not shown) may be run into the well contemporaneously with the apparatus 10 to shoulder on the upper most end of a lock ring subassembly 400. Thereafter, the conduit is picked up at the top of the well along with the control mandrel 11 to cause relative movement between the lock ring subassembly 400 and the mandrel 11 through the shoe 12. Such movement is continued until shearing of the upper shear pins 107 in the upper cone 106. Continued upward pull on the conduit will cause the control mandrel 11 to travel upwardly moving the upper cone into the upper slips 101A–H of the slip assembly 100 and, in turn, move the slips outwardly and along the smooth taper 106A of the cone 106. As the slip members 101A–H begin to move outwardly, the expansion force will be applied to the belt 104 and through the screw 106A until the screw 106A is torn away from its positioning through the belt 104 at the point 106B, and then the metal belt 104 will be caused to be unwrapped within the grooveway 103. The unwrapping of the belt 104 will permit the slip members 101A–H in the upper slip assembly 100 to continue to move outwardly. As upward pull continues to be applied on the mandrel 11 the upper cone 106 continues moving the upper slips outwardly until such time as the resistence to such unwrapping of the belt 104 is overcome by either the breaking or flexing of the wire wrap 105 or the unwinding of the wire wrap 105 at twist 105A. Thereafter, the unwrapping of the belt 104 may continue, but the belt 104 is always contained within the grooveway 103 by the effective interface between the upper and lower shoulders 103A and 103B relative to the upper and lower edges 104A and 104B of the belt 104 such that continued outer movement of the slip members 101A–101H as a result of continued pull on the control mandrel 11 will result in each of the slip members 101A–101H moving in a substantially uniform axial plane of expansion, as shown in FIG. 4.

The outer movement of the upper slips 101A–H is continued until the teeth 102 grasp the inner wall of the casing C. Subsequent upward pull on the control mandrel 11 will cause the lower slip assembly 100 to be activated moving the lower slips 101A–H into the lower cone 106. Thereafter, continued pull on the mandrel 11 is transferred into the elastomeric packer 201 which sealingly engages along the wall. The upper and lower backup seal assemblies 203 will become compressed between elastomeric packer 201 and the outer metal shield members 303. The metal shields 303 are rotationally staggered relative to one another to cover any open areas there between and to prevent extrusion of the elastomeric nitrile backup component 202 between the metal support members 203. This permits use of a high compressive load that effects the seal of the elastomeric packer 201 which, in turn, allows a higher differential pressure rating for the entire apparatus 10 at high expansion ratios. The apparatus 10 is now in the set and anchored position as shown in FIG. 4.

It will be appreciated that it is also possible to provide the slip assembly configuration as a single initial unit as opposed to separate, individual slip members. Additionally, the slip assembly may be designed to anchor in both directions thus necessitating the use of only one slip assembly and eliminating a duplicate slip assembly. When the slip assembly is provided as a single unit as opposed to separate components, a thin membrane or the like may be provided between the segment configurations to hold them together as one unit such that the thin membrane will break during early stress resulting from manipulation of the mandrel.

Furthermore, it will be appreciated that other means such as the "bailing wire" may be substituted, such as an extension spring provided in a loop configuration, or the like.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A slip assembly for anchoring a subterranean well tool along a conduit inner wall against movements in at least one direction, comprising:

(a) a series of radially aligned slip means moveable from a contracted position to an expanded position; and (b) means for applying a continuous radial inwardly urging bias against said slip means whereby said slip means move in a substantially uniform axial plane of expansion during movements to said expanded position.

2. The slip assembly of claim 1 wherein said applying means includes means for reducing said bias as said slip means are moved toward the expanded position.

3. The slip assembly of claim 1 further including means for moving said slip means between said contracted and expanded positions.

4. The slip assembly of claim 1 wherein said slip means includes serrated teeth thereon for grasping said inner wall of said conduit.

5. The slip assembly of claim 2 further comprising cover means for enclosing said means for reducing said bias.

6. The slip assembly of claim 1 further including an expandable band disposed exteriorly around said means for applying said bias.

7. The slip assembly of claim 2 wherein said means for reducing said bias comprises an expandable band disposed exteriorly around said means for applying said bias.

8. The slip assembly of claim 1 wherein the means for applying bias comprises a continuous length of flat flexible metallic material.

9. A slip assembly for anchoring a subterranean well tool along a conduit inner wall against movements in at least one direction, comprising:

(a) a series of radially aligned slip means moveable from a contracted position to an expanded position;

(b) a receiving profile including first and second shoulders defined upon said slip means; and (c) means carried within said profile and abutting said shoulders for applying a continuous inwardly urging circumferential bias against said slip means during movements to said expanded position.

10. The slip assembly of claim 9 wherein said applying means includes means for reducing said bias as said slip means are moved toward the expanded position.

11. The slip assembly of claim 2 wherein said means for reducing said bias comprises an expandable band disposed exteriorly around said means for applying said bias.

12. A slip assembly for anchoring a subterranean well tool along a inner wall of a conduit against movements in at least one direction, comprising:

(a) a series of radially aligned slip means manipulatable from a contracted position to an expanded position;

(b) a grooveway exteriorly defined around each of said slip means and including first and second shoulders;

(c) elongated belt means housed within said grooveway and wrappingly positioned around said slip means;

(d) means for securing one end of said belt means to said slip means; and (e) means for resisting unwrapping of said belt means, whereby movements of said slip means toward said expanded position induces unwrapping of said belt means while continuous abutting relationship is retained between said belt means and said shoulders for resistance to axial misalignment of said slip means during manipulation to the expanded position.

13. The slip assembly of claim 12 her comprising means for moving said slip means between said first and second positions.

14. The slip assembly of claim 12 wherein said slip means further comprises serrated teeth thereon for grasping said inner wall of said conduit.

15. The slip assembly of claim 12 further comprising cover means for enclosing within said grooveway said means for resisting unwrapping of said belt means.

16. The slip assembly of claim 12 wherein said means for resisting unwrapping of said belt means comprises an expandable band disposed exteriorly around said belt means.

17. This slip assembly of claim 12 wherein said elongated belt means comprises a continuous length of flat flexible metallic material.

18. The slip assembly of claim 15 wherein said cover means comprises a plurality of O-ring seals.

19. A subterranean well tool for setting along a first conduit inner wall and against movements in at least one direction, comprising:

(a) means of securing said tool to a second conduit for carrying said tool within said well;

(b) an elastomer moveable into sealing relationship with said inner wall during setting of said tool;

(c) a slip assembly for anchoring said well tool along said inner wall and against movements in at least one direction, said slip assembly including:

(1) a series of radially aligned slip means moveable from a contracted position to an expanded position; and (2) means for applying a continuously radial inwardly urging bias against said slip means whereby said slip means move in a substantially uniform axial plane of expansion during movements to said expanded position.

20. The subterranean well tool of claim 19 further comprising:

(d) first and second secondary seal members disposed at each end of the elastomer; said secondary seal members including:

(1) a sealant ring;

(2) a series of axially overlapping expandable metal sheets forming a shield with an interior shell; and (3) shield means having a portion housed within the interior shell of the metal sheets and shouldered at one end against the primary elastomeric seal.

21. A subterranean well tool for setting along a first conduit inner wall and against movements in at least one direction, comprising:

(a) means of securing said tool to a second conduit for carrying said tool within said well;

(b) an elastomer moveable into sealing relationship on said inner wall during setting of said tool;

(c) a slip assembly for anchoring said well tool along said inner wall and against movements in at least one direction, said slip assembly including:

(1) a series of radially aligned slip means manipulatable from a contracted position to an expanded position;

(2) a receiving profile including first and second shoulders defined upon said slip means; and (3) means carried within said profile and abutting said shoulders applying a continuous inwardly urging circumferential bias against said slip means during movements to said expanded position.

22. A subterranean well tool for setting along a first conduit inner wall and against movements in at least one direction, comprising:

(a) means for securing said tool to a second conduit for carrying said tool within said well;

(b) an elastomer moveable into sealing relationship with said inner wall during setting of said tool;

(c) a slip assembly for anchoring said well tool along said inner wall and against movements in at least one direction, said slip assembly including:

(1) a series of radially aligned slip means manipulatable from a contracted position to an expanded position;

(2) a grooveway exteriorly defined around each of said slip means and including first and second shoulders;

(3) elongated belt means housed within said grooveway and wrappingly positioned around said slip means;

(d) means for securing one end of belt means to said slip means; and (e) means for resisting unwrapping of said belt means, whereby manipulation of said slip means toward said expanded position induces unwrapping of said belt means while continuous abutting relationship is retained between said belt means and said shoulders for resistance to axial misalignment of said slip means during manipulation to the expanded position.

23. A slip assembly for anchoring a subterranean well tool along a conduit inner wall against movements in at least one direction, comprising:

(a) a series of radially aligned slip means movable from a contracted position to an expanded position; and (b) means to prevent axial misalignment of said slip means during movements between said positions and whereby during movements between said position each of said slip means retain initial uniform axial orientation relative to all other of said slip means.

24. The slip assembly of claim 23 further comprising means for applying continuous radial inwardly urging bias against said slip means whereby said slip means move in a substantially uniform axial plane of expansion during movements to said expanded position.

25. The slip assembly of claim 23 wherein said means to prevent axial misalignment of said slip means includes cone means for directing movements of said slips means between contracted and expanded positions and at least one pin member carried by one of said slip means and said cone means and received within a groveway defined on the other of said slip means and said cone means whereby each of said slip means retain initial uniform circumferential alignment between each of the slip means during movements to the expanded position.

26. A slip assembly for anchoring a subterranean well tool along a conduit inner wall against movements in at least one direction, comprising:

(a) a control mandrel for moving said slip assembly from a contracted position to an anchoring position, said mandrel including a first length having a first exterior diameter and a second length having a second exterior diameter larger than said first exterior diameter, said first and second exterior diameter lengths being joined by a control mandrel section;

(b) a series of radially aligned slip means including an inner wall defining a third diameter small than the second exterior diameter of the second length of the mandrel and greater than the first exterior diameter of the first length of the mandrel, said slip means further including a line of taper extending from said third exterior diameter inner wall;

(c) wedging means around the second exterior diameter of the mandrel, said wedging means having a portion thereof sandwiched between the mandrel and the slip means when said slip assembly is in the contracted position, whereby manipulation of the control mandrel directs alignment of the second and third exterior diameter lengths and said wedging means drive said slip means along said line of taper and into said anchoring position; and (d) means for applying a continuous radial inwardly urging bias against said slip means whereby said slip means move in a substantially uniform axial plane of expansion during movements to said anchoring position.

27. The slip assembly of claim 26 wherein said applying means includes means for reducing said bias as said slip means are moved toward the expanded position.

28. The slip assembly of claim 27 further comprising means for applying a continuous radial inwardly urging bias against said slip means whereby said slip means move in a substantially uniform axial plane of expansion during movements to said expanded position.

29. A slip assembly for anchoring a subterranean well tool along a conduit inner wall against movements in at least one direction, comprising:

(a) a control mandrel for moving said slip assembly from a contracted position to an anchoring position, said mandrel including a first length having a first exterior diameter and a second length having a second exterior diameter larger than said first exterior diameter, said first and second exterior diameter lengths being joined by a control mandrel section;

(b) a series of radially aligned slip means including an inner wall defining a third diameter small than the second exterior diameter of the second length of the mandrel and greater than the first exterior diameter of the first length of the mandrel, said slip means further including a line of taper extending from said third exterior diameter inner wall; and (c) wedging means around the second exterior diameter of the mandrel, said wedging means having a portion thereof sandwiched between the mandrel and the slip means when said slip assembly is in the contracted position, whereby manipulation of the control mandrel directs alignment of the second and third exterior diameter lengths and said wedging means drive said slip means along said line of taper and into said anchoring position.

30. A slip assembly for anchoring a subterranean well tool along a conduit inner wall against movements in at least one direction, comprising:

(a) a control mandrel for moving said slip assembly from a contracted position to an anchoring position, said mandrel including a first length having a first exterior diameter and a second length having a second exterior diameter larger than said first exterior diameter, said first and second exterior diameter lengths being joined by a control mandrel section;

(b) a series of radially aligned slip means including an inner wall defining a third diameter small than the second exterior diameter of the second length of the mandrel and greater than the first exterior diameter of the first length of the mandrel, said slip means further including a line of taper extending from said third exterior diameter inner wall, said slip means further including a receiving profile including first and second shoulders defined thereon and means carried within said profile and abutting said shoulders for applying a continuous inwardly urging circumferential bias against said slip means during movements to said anchoring position; and (c) wedging means around the second exterior diameter of the mandrel, said wedging means having a portion thereof sandwiched between the mandrel and the slip means when said slip assembly is in the contracted position, whereby manipulation of the control mandrel directs alignment of said second and third exterior diameter lengths and said wedging means drives said slip means along said line of taper and into said anchoring position.

* * * * *